US009859628B1

(12) United States Patent
Bulza

(10) Patent No.: US 9,859,628 B1
(45) Date of Patent: Jan. 2, 2018

(54) INSULATION PIERCING CONNECTOR

(71) Applicant: Tyco Electronics Canada ULC, Markham (CA)

(72) Inventor: Alexandru P. Bulza, Newmarket (CA)

(73) Assignee: Tyco Electronics Canada ULC, Markham, Ontario (CA)

( * ) Notice: Subject to any disclaimer, the term of this patent is extended or adjusted under 35 U.S.C. 154(b) by 0 days.

(21) Appl. No.: 15/384,903

(22) Filed: Dec. 20, 2016

(51) Int. Cl.
*H01R 4/24* (2006.01)
*H01R 13/426* (2006.01)
*H01R 13/52* (2006.01)

(52) U.S. Cl.
CPC ..... *H01R 4/2483* (2013.01); *H01R 13/426* (2013.01); *H01R 13/5213* (2013.01)

(58) Field of Classification Search
CPC . H01R 13/5213; H01R 13/426; H01R 4/2483
USPC ..... 439/416, 475, 98, 100, 431
See application file for complete search history.

(56) References Cited

U.S. PATENT DOCUMENTS 1,690,220 A * 11/1928 Fahnestock ..... H01R 4/60 439/100
3,094,366 A * 6/1963 Harmon, Jr. ..... H01R 11/20 24/16 R
3,549,787 A * 12/1970 Churla, Jr. ..... H01R 4/186 174/75 C
4,588,249 A * 5/1986 Blichasz ..... H01R 9/0509 439/394
4,675,952 A * 6/1987 Nagano ..... B62M 9/135 24/278
6,402,544 B1 * 6/2002 Barnett ..... H01R 4/2483 439/416
6,727,430 B1 * 4/2004 Franks, Jr. ..... H01R 4/643 174/135
7,780,461 B1 * 8/2010 Vernica ..... H01R 4/36 439/100
8,550,842 B1 10/2013 Gutierrez et al.
9,147,967 B2 9/2015 Johnson et al.
9,287,673 B2 3/2016 Galla et al.
2008/0102660 A1 * 5/2008 Wittwer ..... B61G 5/06 439/100

* cited by examiner

*Primary Examiner* — Abdullah Riyami
*Assistant Examiner* — Nelson R Burgos-Guntin
(74) *Attorney, Agent, or Firm* — Myers Bigel, P.A.

(57) ABSTRACT

An insulation piercing connector includes a body having a bore extending therethrough. One or more clamps secure the body to an electrical cable At least a portion of the bore is threaded or a threaded member is associated therewith. A piercing pin is threadingly engaged with the bore threads or the threaded member and includes a first end configured to pierce the insulation of the electrical cable and contact a conductor as the piercing pin is rotated in a first direction. The piercing pin includes a head that is configured to shear off as a result of torque exceeding a predetermined value after the first end contacts the conductor. The probe of a sensor can contact the second end of the piercing pin to obtain information from the conductor, such as voltage, current, and/or thermal information.

15 Claims, 2 Drawing Sheets

INSULATION PIERCING CONNECTOR

FIELD OF THE INVENTION

The present invention relates to electrical cables and, more particularly, to connectors for electrical cables.

BACKGROUND

Conventional insulation piercing connectors are used to form mechanical and electrical connections between insulated cables. Typically, a conventional insulation piercing connector includes metal piercing blades with sets of teeth on either end thereof. The piercing blades are mounted in housing members (e.g., along with environmental sealing components). The housing members are clamped about insulated main and tap cables so that one set of teeth of a piercing blade engages the main cable and the other set of teeth of the piercing blade engages the tap cable. The teeth penetrate the insulation layers of the cables and make contact with the underlying conductors, thereby providing electrical continuity between the conductors through the piercing blade. Conventional insulation piercing connectors can be somewhat complex and cumbersome to install in the field. As such, a need exists for insulation piercing connectors that can be easily and quickly installed in the field without requiring special tools.

SUMMARY

According to embodiments of the present invention, an insulation piercing connector for attachment to an electrical cable includes a body having opposite first and second sides, and a bore extending from the first side to the second side. The second side of the body is configured for engagement with an outer surface of an electrical cable and, in some embodiments, may have an arcuate configuration. At least one clamp, such as an adjustable clamp, is configured to secure the body to the electrical cable. In some embodiments, the body has an elongate configuration with opposite end portions. A clamp may be utilized at each respective end portion of the body to secure the body to the electrical cable.

At least a portion of the bore of the body is threaded or a threaded member, such as a nut, is associated with the bore. A piercing bolt or pin is disposed within the bore. The piercing pin includes opposite first and second ends, and a threaded intermediate portion between the first and second ends that is threadingly engaged with the bore threads or the threaded member associated with the bore. The first end of the piercing pin is configured to pierce the insulation of the electrical cable and contact a conductor of the electrical cable as the piercing pin is rotated in a first direction. The piercing pin includes a head that is joined to the second end by a shear-off section. Rotation of the piercing pin head causes the first end of the piercing pin to pierce the insulation of the electrical cable, and the head is configured to shear off as a result of torque exceeding a predetermined value after the first end of the piercing pin contacts the conductor. The probe of a sensor can contact the second end of the piercing pin to obtain information from the conductor, such as voltage, current, and/or thermal information, etc.

In some embodiments, the connector includes a cap that is removably secured to the bore of the body after the head is sheared off. The cap is configured to seal the bore from exposure to the environment. A gel or sealant may also be used to protect the bore and underlying electrical cable from exposure to the environment.

According to other embodiments of the present invention, an insulation piercing connector for an electrical cable, includes a body having opposite first and second sides, opposite end portions, a medial portion between the opposite end portions, and a bore within the medial portion that extends from the first side to the second side. At least a portion of the bore includes threads or a threaded member therein. The insulation piercing connector further includes a pair of clamps, each configured to secure a respective end portion of the body to the electrical cable. Each clamp includes a circular band with free ends that are adjustably secured together to cause the band to tighten around the electrical cable. A piercing pin is disposed within the bore and includes opposite first and second ends, a threaded intermediate portion between the first and second ends that is threadingly engaged with the threads or the threaded member, and a head that is joined to the second end by a shear-off section. Rotation of the piercing pin head causes the first end of the piercing pin to pierce insulation of the electrical cable and contact a conductor of the electrical cable, and the head is configured to shear off by a torque exceeding a predetermined value after the first end of the piercing pin contacts the conductor.

In some embodiments, the connector includes a cap that is removably secured to the bore of the body after the head is sheared off. The cap is configured to seal the bore from exposure to the environment. A gel or sealant may also be used to protect the bore and underlying electrical cable from exposure to the environment.

It is noted that aspects of the invention described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail below.

BRIEF DESCRIPTION OF THE DRAWINGS

The accompanying drawings, which form a part of the specification, illustrate some exemplary embodiments. The drawings and description together serve to fully explain the exemplary embodiments.

DETAILED DESCRIPTION

Figure 1A:
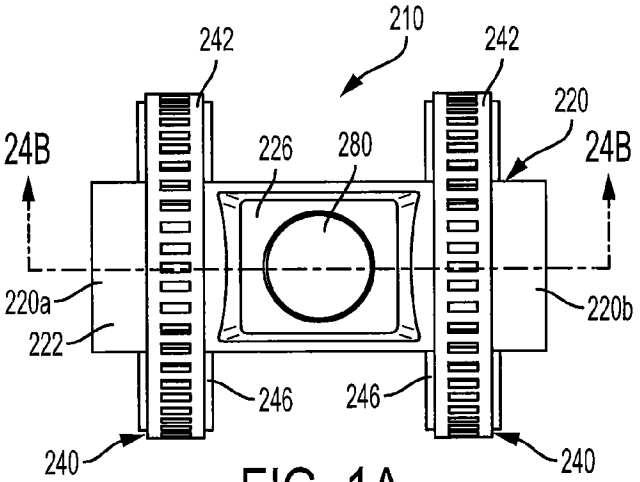
FIG. 1A is a top plan view of the insulation piercing connector of FIG. 1.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

The term "about", as used herein with respect to a value or number, means that the value or number can vary by +/−twenty percent (20%).

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Referring now to FIGS. 1, 1A-1D and 2, a connector 210 for an electrical cable, according some embodiments of the present invention, will be described. Exemplary electrical cables with which the connector 210 can be utilized include, but are not limited to, low voltage electrical power cables (e.g., up to about 1000V) and medium voltage electrical power cables (e.g., up to about 65 kV). However, connectors according to embodiments of the present invention may be utilized with various other types of electrical power cables, also. The illustrated connector 210 includes a body 220 having an elongate configuration with opposite first and second sides 222, 224, opposite end portions 220*a*, 220*b*, and a medial portion 226 between the opposite end portions 220*a*, 220*b*. The body 220 may be formed from various types of insulating/dielectric material including, but not limited to, polymeric material. A bore 228 (FIG. 1B) extends from the body first side 222 to the body second side 224 through the medial portion 226. The second side 224 of the body 220 is configured for engagement with an outer surface of an electrical cable and, in the illustrated embodiment, has an arcuate configuration.

Figure 1:
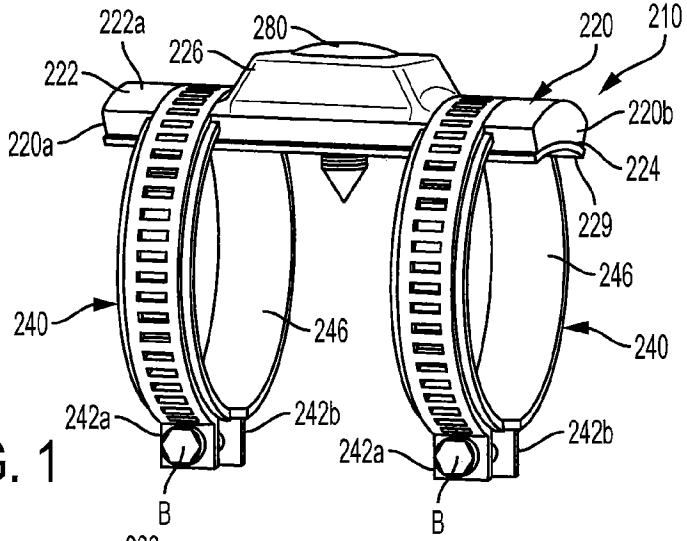
FIG. 1 is a perspective view of an insulation piercing connector for attachment to an electrical cable, according to some embodiments of the present invention.
Figure 1D:
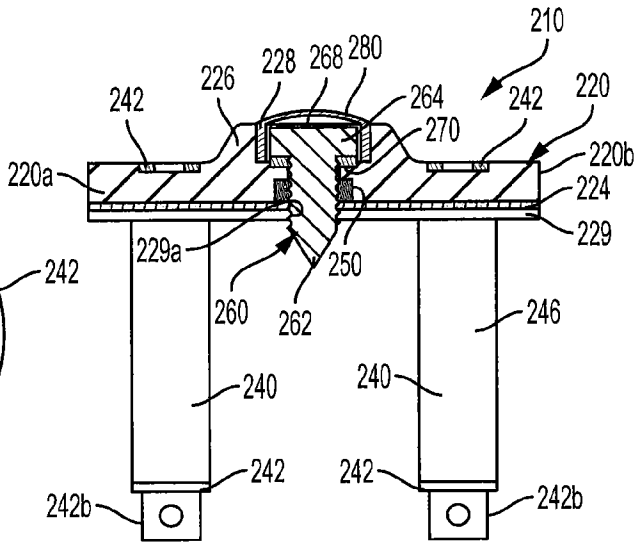
FIG. 1D is a cross-sectional view of the insulation piercing connector of FIG. 1A taken along line 1B-1B of FIG. 1A and after the head portion of the piercing pin has been sheared off.
Figure 1C:
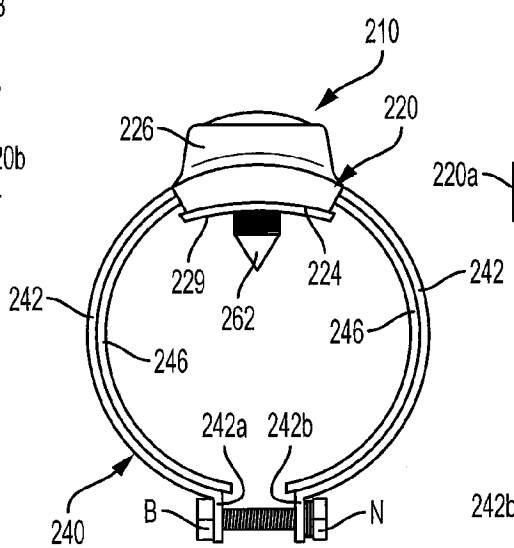
FIG. 1C is an end view of the insulation piercing connector of FIG. 1.

In the illustrated embodiment, a flexible seal 229 (e.g., formed from rubber or other polymeric material, etc.) is secured to the body second side 224 and is configured to be positioned between the body second side 224 and an electrical cable. The flexible seal 229 may be formed from a sheet of resilient material and includes an aperture 229*a* through which the piercing pin 260 extends, as illustrated in FIG. 1C. The seal 229 can protect the electrical cable from the environment when the piercing pin 260 penetrates the insulation (I, FIG. 2) of the electrical cable (EC, FIG. 2).

Figure 1B:
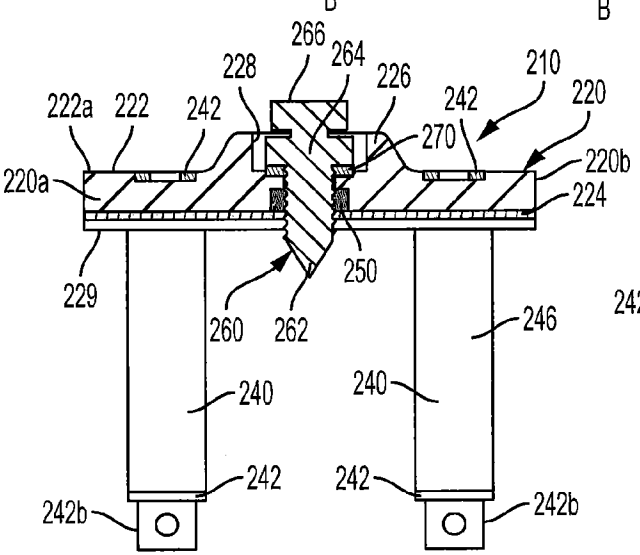
FIG. 1B is a cross-sectional view of the insulation piercing connector of FIG. 1A taken along line 1B-1B of FIG. 1A and before the head portion of the piercing pin has been sheared off.
Figure 2:
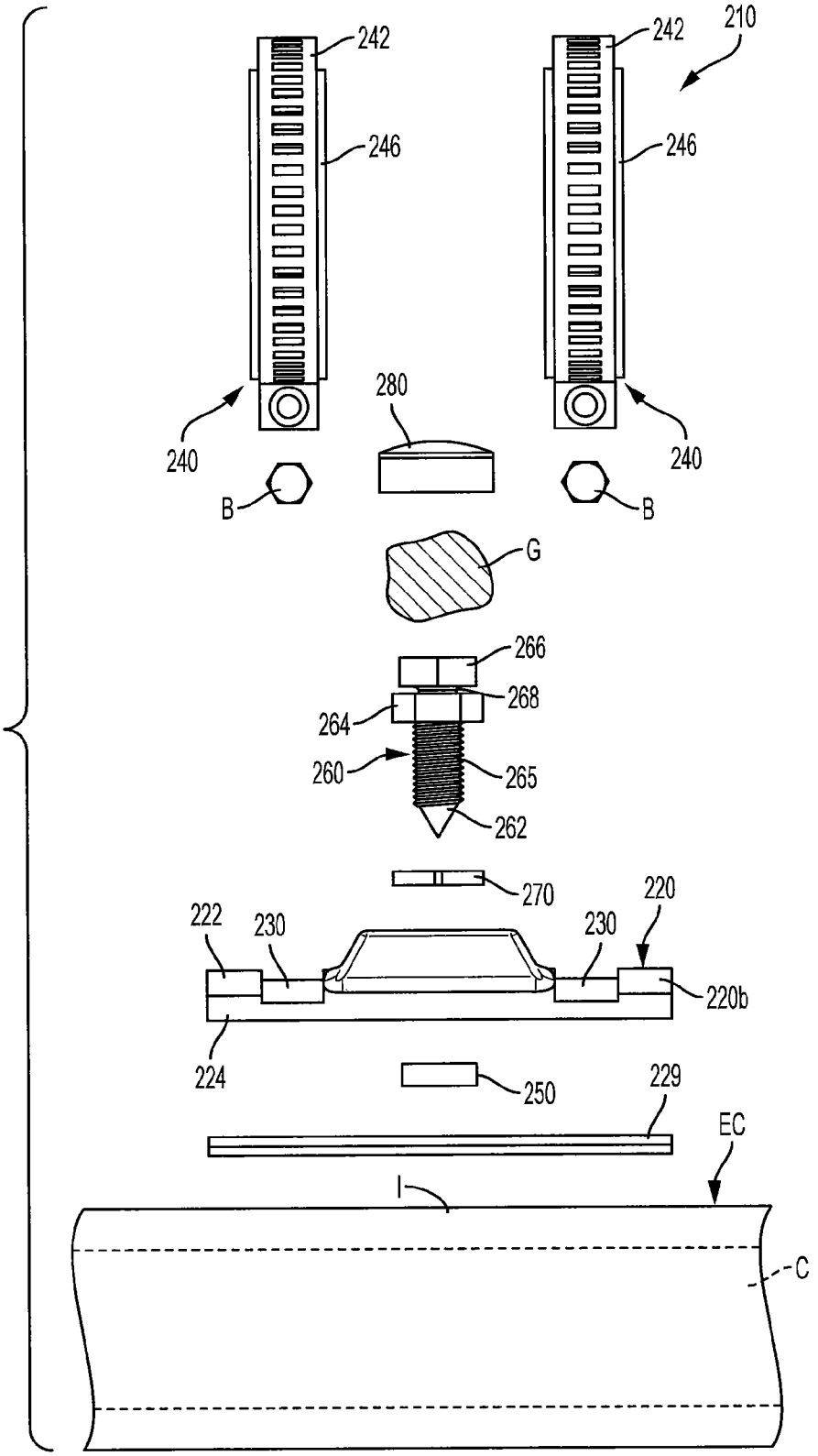
FIG. 2 is an exploded view of the insulation piercing connector of FIG. 1.

Recessed portions or channels 230 are formed in the first side 222 of the body 220 at each end portion 220*a*, 220*b*, as illustrated in FIG. 2. Each channel 230 receives a portion of a respective clamp 240 therein, as illustrated in FIGS. 1, 1B and 1D. Each clamp 240 is configured to secure the body 220 to an electrical cable. The illustrated clamps 240 are adjustable clamps, and each includes a generally circular band 242 with free ends 242*a*, 242*b* that are adjustably secured together via a bolt B and nut N. By threading the bolt B into the nut N, the diameter of the band 242 is reduced, thereby causing the band 242 to tighten around an electrical cable (EC, FIG. 2), as would be understood by one skilled in the art. An exemplary material for each band 242 includes, but is not limited to, stainless steel. However, various types of material may be utilized. Embodiments of the present invention are not limited to the use of stainless steel. Each of the illustrated clamps 240 also includes a protective liner 246 (e.g., formed from rubber or other elastomeric material, etc.) within each band 242 that is configured to contact the electrical cable EC. In the illustrated embodiment, a portion of each band 242 is located within a respective channel 230 such that the portion of the band 242 within the channel 230 is substantially flush with the outer surface 222*a* of the first side 222 (FIGS. 1B and 1D).

Embodiments of the present invention are not limited to the illustrated clamps 240. Various types of clamps may be utilized for securing the body 220 to an electrical cable. For example, in some embodiments, each clamp 240 may have a "hose-clamp" configuration that utilizes a screw drive mechanism that engages each circular band 242. When the screw drive is turned in a first direction, the circular band 242 is reduced in diameter about an electrical cable to secure the connector 210 to the electrical cable. When the screw drive is turned in a second direction, the circular band 242 is increased in diameter thereby permitting the connector 210 to be removed from the electrical cable, as would be understood by one skilled in the art.

In the illustrated embodiment, a threaded member 250 (FIG. 1D), such as a nut, is associated with the bore 228 in the connector body 220. As will be described below, the piercing pin 260 is threadingly engaged with the threaded member 250. However, in other embodiments, the bore 228 may have a portion that is threaded, or may include a threaded bushing, that the piercing pin 260 threadingly engages.

The connector 210 includes a piercing pin 260 that is disposed within the bore 228. The piercing pin 260 includes opposite first and second ends 262, 264, and a threaded intermediate portion 265 between the first and second ends 262, 264 that is threadingly engaged with the threaded member 250. The first end 262 of the piercing pin 260 has a conical shape that is configured to pierce the insulation of an electrical cable EC (FIG. 2) and contact a conductor or conductor strands (C, FIG. 2) of the electrical cable EC as the piercing pin 260 is threadingly engaged with the threaded member 250. In the illustrated embodiment, a lock washer 270 is included that is configured to help retain the piercing pin 260 engaged with an electrical cable by compressing between the piercing pin second end 264 and a portion of the bore 228 or connector body 220, as would be understood by one skilled in the art. Piercing pins 260 in accordance with embodiments of the present invention can have various lengths and sizes depending on the size of an electrical cable and/or conductor, the thickness and type of the insulation, etc.

The illustrated piercing pin 260 includes a head 266 that is joined to the second end 264 by a shear-off section 268 (e.g., an undercut in the piercing pin material). The head 266 has a hexagonal shape such that the piercing pin 260 can be turned with a wrench. Rotation of the piercing pin head 266 (e.g., in a clockwise direction) causes the first end 262 of the piercing pin 260 to pierce the insulation I of the electrical cable EC. The head 266 is configured to shear off by a torque exceeding a predetermined value after the first end 262 of the piercing pin 260 contacts a conductor C within the electrical cable EC. The second end 264 of the illustrated piercing pin 260 also has a hexagonal shape such that the piercing pin 260 can be turned (e.g., in a counter-clockwise direction) with a wrench (e.g., to remove the piercing pin 260 from a cable) after the head 266 has been sheared off.

The probe of a sensor, such as a handheld sensor, can be extended into the bore 228 and contact the exposed second end 264 of the piercing pin 260 to obtain information from the conductor, such as voltage, current, and/or thermal information, etc. In some embodiments, the medial portion 226 of the body 220 can be configured to allow a sensor to be attached thereto, e.g., threadably attached, etc.

The illustrated connector 210 includes a cap 280 that is removably secured to the bore 228 of the body 220 after the piercing pin head 266 is sheared off. The cap 280 is configured to help protect the bore 228 and the underlying electrical cable EC from exposure to the environment.

A sealant or gel G may also be used within the cap 280 to facilitate sealing of the bore 228 from the environment and various liquids. Various types of sealant gels may be utilized including, but not limited to, silicone gels, polyurethane gels, gels based on styrene-ethylene butylenestyrene (SEBS) or styrene-ethylene propylene-styrene (SEPS), EPDM rubber-based gels, gels based on anhydride-containing polymers, and the like. An exemplary manufacturer of suitable gels is Continental Products Corporation, Osseo, Wis. The sealant gel may include a variety of additives, including stabilizers and antioxidants such as hindered phenols (e.g., Irganox™ 1076, commercially available from Ciba-Geigy Corp. of Tarrytown, N.Y.), phosphites (e.g., Irgafos™ 168, commercially available from Ciba-Geigy Corp. of Tarrytown, N.Y.), metal deactivators (e.g., Irganox™ D1024 from Ciba-Geigy Corp. of Tarrytown, N.Y.), and sulfides (e.g., Cyanox LTDP, commercially available from American Cyanamid Co. of Wayne, N.J.), light stabilizers (e.g., Cyasorb UV-531, commercially available from American Cyanamid Co. of Wayne, N.J., and flame retardants such as halogenated paraffins (e.g., Bromoklor 50, commercially available from Ferro Corp. of Hammond, Ind.) and/or phosphorous containing organic compounds (e.g., Fyrol PCF and Phosflex 390, both commercially available from Akzo Nobel Chemicals Inc. of Dobbs Ferry, N.Y.) and acid scavengers (e.g., DHT-4A, commercially available from Kyowa Chemical Industry Co. Ltd through Mitsui & Co. of Cleveland, Ohio, and hydrotalcite). Other suitable additives include colorants, biocides, tackifiers and the like described in "Additives for Plastics, Edition 1" published by D.A.T.A., Inc. and The International Plastics Selector, Inc., San Diego, Calif.

Insulation piercing connectors according to embodiments of the present invention are advantageous over conventional connectors because the robust wrap-around design facilitates easy installation on insulated conductors and without requiring special installation tools. Moreover, no cable stripping or cutting is required. For underground installations such as manholes, cable trenches, and the like, insulation piercing connectors according to embodiments of the present invention allow a technician to assess power in an insulated conductor just by pointing a measurement device to the piercing pin head of a connector attached to the insulated conductor through the gel.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. An insulation piercing connector for an electrical cable, the connector comprising:

a body comprising opposite first and second sides, and a bore extending from the first side to the second side, wherein at least a portion of the bore comprises threads or a threaded member, and wherein the second side is configured for engagement with an outer surface of an electrical cable;

at least one clamp configured to secure the body to the electrical cable;

a piercing pin disposed within the bore, wherein the piercing pin comprises opposite first and second ends, and a threaded intermediate portion between the first and second ends that is threadingly engaged with the threads or the threaded member, wherein the piercing pin comprises a head that is joined to the second end of the piercing pin by a shear-off section, wherein rotation of the piercing pin head in a first direction causes the first end of the piercing pin to pierce insulation of the electrical cable, and wherein the head is configured to be sheared off by a torque exceeding a predetermined value after the first end of the piercing pin contacts the conductor; and a cap that is configured to be removably secured to the bore of the body after the head is sheared off, wherein the cap is configured to seal the bore from exposure to the environment.

2. The connector of claim 1, wherein the second side of the body has an arcuate configuration.

3. The connector of claim 1, wherein the body comprises opposite end portions, and wherein the at least one clamp comprises a pair of clamps, each clamp configured to secure a respective end portion of the body to the electrical cable.

4. The connector of claim 3, wherein each end portion of the body comprises a channel and wherein a portion of each clamp is retained within a respective channel.

5. The connector of claim 1, further comprising a sheet of resilient material secured to the second side of the body, wherein the sheet of resilient material comprises an aperture through which the piercing pin first end extends.

6. The connector of claim 1, wherein the at least one clamp comprises a circular band with free ends that are adjustably secured together to cause the band to tighten around the electrical cable.

7. An insulation piercing connector for an electrical cable, the connector comprising:

a body comprising opposite first and second sides, opposite end portions, a medial portion between the opposite end portions, and a bore within the medial portion that extends from the first side to the second side, wherein at least a portion of the bore comprises threads or a threaded member, and wherein the second side is configured for engagement with an outer surface of an electrical cable;

a pair of clamps, each clamp configured to secure a respective end portion of the body to the electrical cable;

a piercing pin disposed within the bore, wherein the piercing pin comprises opposite first and second ends, and a threaded intermediate portion between the first and second ends that is threadingly engaged with the threads or the threaded member, wherein the piercing pin comprises a head that is joined to the second end of the piercing pin by a shear-off section, wherein rotation of the piercing pin in a first direction head causes the first end of the piercing pin to pierce insulation of the electrical cable, and wherein the head is configured to be sheared off by a torque exceeding a predetermined value after the first end of the piercing pin contacts the conductor; and a cap that is configured to be removably secured to the bore of the body after the head is sheared off, wherein the cap is configured to seal the bore from exposure to the environment.

8. The connector of claim 7, wherein the second side of the body has an arcuate configuration.

9. The connector of claim 7, wherein each end portion of the body comprises a channel and wherein a portion of each clamp is retained within a respective channel.

10. The connector of claim 7, further comprising a sheet of resilient material secured to the second side of the body, wherein the sheet of resilient material comprises an aperture through which the piercing pin first end extends.

11. The connector of claim 7, wherein each clamp comprises a circular band with free ends that are adjustably secured together to cause the band to tighten around the electrical cable.

12. An insulation piercing connector for an electrical cable, the connector comprising:

a body comprising opposite first and second sides, opposite end portions, a medial portion between the opposite end portions, and a bore within the medial portion that extends from the first side to the second side, wherein at least a portion of the bore comprises threads or a threaded member, and wherein the second side is configured for engagement with an outer surface of an electrical cable;

a pair of clamps, each clamp configured to secure a respective end portion of the body to the electrical cable, wherein each clamp comprises a circular band with free ends that are adjustably secured together to cause the band to tighten around the electrical cable; and a piercing pin disposed within the bore, wherein the piercing pin comprises:

opposite first and second ends;

a threaded intermediate portion between the first and second ends that is threadingly engaged with the threads or the threaded member;

head that is joined to the second end of the piercing pin by a shear-off section, wherein rotation of the piercing pin head causes the first end of the piercing pin to pierce insulation of the electrical cable and contact a conductor of the electrical cable, and wherein the head is configured to be sheared off by a torque exceeding a predetermined value after the first end of the piercing pin contacts the conductor; and a cap that is configured to be removably secured to the bore of the body after the head is sheared off, wherein the cap is configured to seal the bore from exposure to the environment.

13. The connector of claim 12, wherein the second side of the body has an arcuate configuration.

14. The connector of claim 12, wherein each end portion of the body comprises a channel and wherein a portion of each clamp is retained within a respective channel.

15. The connector of claim 12, further comprising a sheet of resilient material secured to the second side of the body, wherein the sheet of resilient material comprises an aperture through which the piercing pin first end extends.

* * * * *